US010144102B2

(12) United States Patent
Benoit

(10) Patent No.: US 10,144,102 B2
(45) Date of Patent: Dec. 4, 2018

(54) PIPE BEVELING TOOL

(71) Applicant: Hugo Benoit, St-Jean-Baptiste (CA)

(72) Inventor: Hugo Benoit, St-Jean-Baptiste (CA)

( * ) Notice: Subject to any disclaimer, the term of this patent is extended or adjusted under 35 U.S.C. 154(b) by 208 days.

(21) Appl. No.: 15/216,874

(22) Filed: Jul. 22, 2016

(65) Prior Publication Data

US 2017/0021472 A1 Jan. 26, 2017

(30) Foreign Application Priority Data

Jul. 22, 2015 (GB) ..... 1512961.2

(51) Int. Cl.
*B24B 9/00* (2006.01)
*B24B 23/00* (2006.01)
*B24B 23/08* (2006.01)

(52) U.S. Cl.
CPC ..... *B24B 9/007* (2013.01); *B24B 23/005* (2013.01); *B24B 23/08* (2013.01)

(58) Field of Classification Search
CPC ..... B24B 9/007; B24B 23/005; B24B 23/08; B23C 1/22; Y10T 82/22; B23B 5/168
See application file for complete search history.

(56) References Cited

U.S. PATENT DOCUMENTS 3,131,599 A 5/1964 MacFarlane et al.
3,164,062 A 1/1965 Hogden et al.
3,335,526 A 8/1967 Weiss
3,712,174 A * 1/1973 Granfield ..... B23B 5/16 409/138
4,180,358 A * 12/1979 Uribe ..... B23B 5/16 409/179
4,483,222 A 11/1984 Davis
4,615,243 A 10/1986 Davis
4,633,621 A * 1/1987 Weber ..... B23B 5/168 30/123
4,682,919 A * 7/1987 Mitchell ..... B23D 21/04 30/97
5,522,684 A 6/1996 Heck
6,079,302 A 6/2000 Gudleske
6,146,067 A * 11/2000 Owens ..... B23B 5/168 30/122
7,082,656 B1 8/2006 Duncan et al.
7,103,950 B1 9/2006 Scheffer
8,297,157 B1 10/2012 Miller et al.
9,802,285 B2 * 10/2017 Rieth ..... B23Q 9/0021
2010/0120341 A1 * 5/2010 Rieth ..... B24B 23/005 451/359

(Continued)

FOREIGN PATENT DOCUMENTS

DE 905963 3/1954
DE 2826413 12/1979

(Continued)

*Primary Examiner* — Joshua T Kennedy

(57) ABSTRACT

A pipe beveling tool has an arcuate pipe adapter mechanically attached to a wedge member, which is itself mechanically attached to a connecting bracket which is itself mechanically fastened to a disc cover member in such a way that both the disc cover member, and the connecting bracket clamp onto a grinding tool section proximal a grinding disc by way of tightening thereonto. The pipe adapter has a pair of flaps hingedly attached to a fixed adapter member so as to adapt to various pipe diameters.

3 Claims, 4 Drawing Sheets

(56) References Cited

U.S. PATENT DOCUMENTS

| | | | | |
|---|---|---|---|---|
| 2012/0067190 | A1 | 3/2012 | Tseng et al. | |
| 2015/0290757 | A1* | 10/2015 | Rieth | B23Q 9/02 409/179 |
| 2015/0306682 | A1* | 10/2015 | Merle | B29C 37/04 82/113 |

FOREIGN PATENT DOCUMENTS

| | | | | |
|---|---|---|---|---|
| DE | 102004031756 | A1 * | 1/2006 | B23B 5/163 |
| FR | 2028285 | | 1/1970 | |
| WO | WO2005095052 | | 10/2005 | |
| WO | WO2006119548 | | 11/2006 | |
| WO | WO2014071923 | | 5/2014 | |

* cited by examiner

PIPE BEVELING TOOL

FIELD OF THE INVENTION

The present invention relates generally to tools but more particularly to a pipe beveling tool.

BACKGROUND OF THE INVENTION

In order to join pipe sections together, at least one end of a pipe needs to have its circumference shaped into a bevel. This operation is generally done using a hand held rotary grinder equipped with a sanding disc. Using such a hand held tool makes it very difficult to make a precise and consistent bevel all around the circumference.

SUMMARY OF THE INVENTION

In view of the foregoing disadvantages inherent in the known devices now present in the prior art, the present invention, which will be described subsequently in greater detail, is to provide objects and advantages which are:

To provide for a for pipe beveling tool which helps in achieving a perfect circumferential bevel.

In order to do so, the invention comprises an arcuate pipe adapter mechanically attached to a wedge member, which is itself mechanically attached to a connecting bracket which is itself mechanically fastened to a disc cover member in such a way that both the disc cover member, and the connecting bracket clamp onto a grinding tool section proximal a grinding disc by way of tightening thereonto. The pipe adapter has a pair of flaps hingedly attached to a fixed adapter member so as to adapt to various pipe diameters.

The connecting bracket has a pair of handles extending therefrom so as to hold the pipe beveling tool in place when a pipe is being rotated.

A pair of nipples make contact with an edge section of the pipe so as to hold the pipe beveling tool in place relative to the pipe's circumferential edge when a pipe is being rotated.

A removable cover extension extends the coverage of the disc beyond the cover member.

A wedge member having a chosen angle is mounted onto the beveling tool in such a way as to impart a corresponding bevel angle to the pipe.

The pipe beveling tool works in combination with a pipe. Essentially, the beveling tool is loosely connected to a pipe so that as the pipe is rotated, the beveling tool is held in place so as to bevel the circumference of the rotating pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1:
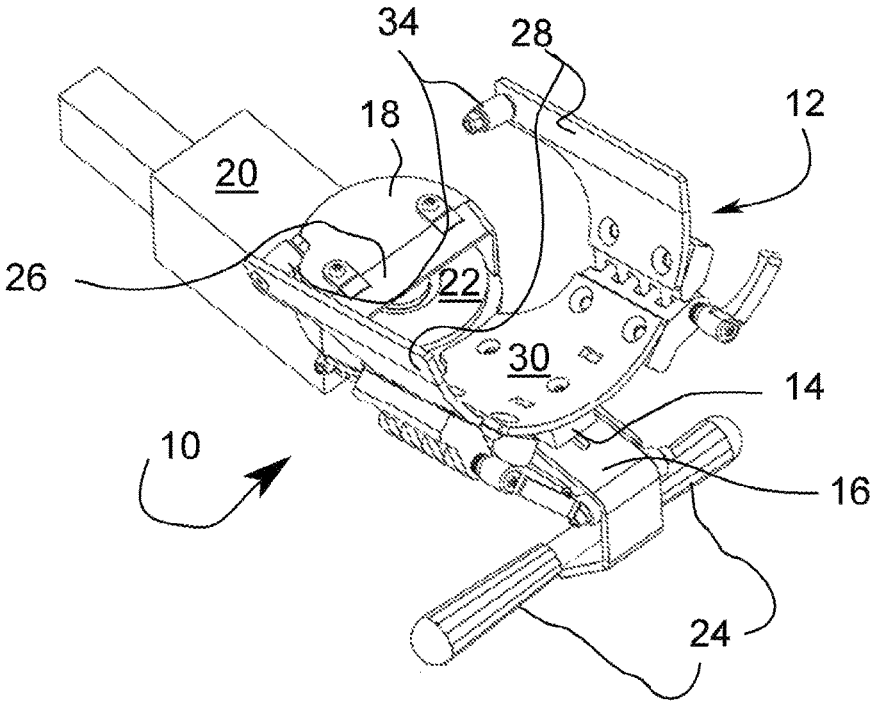
FIG. 1 Isometric view of the invention.
Figure 2:
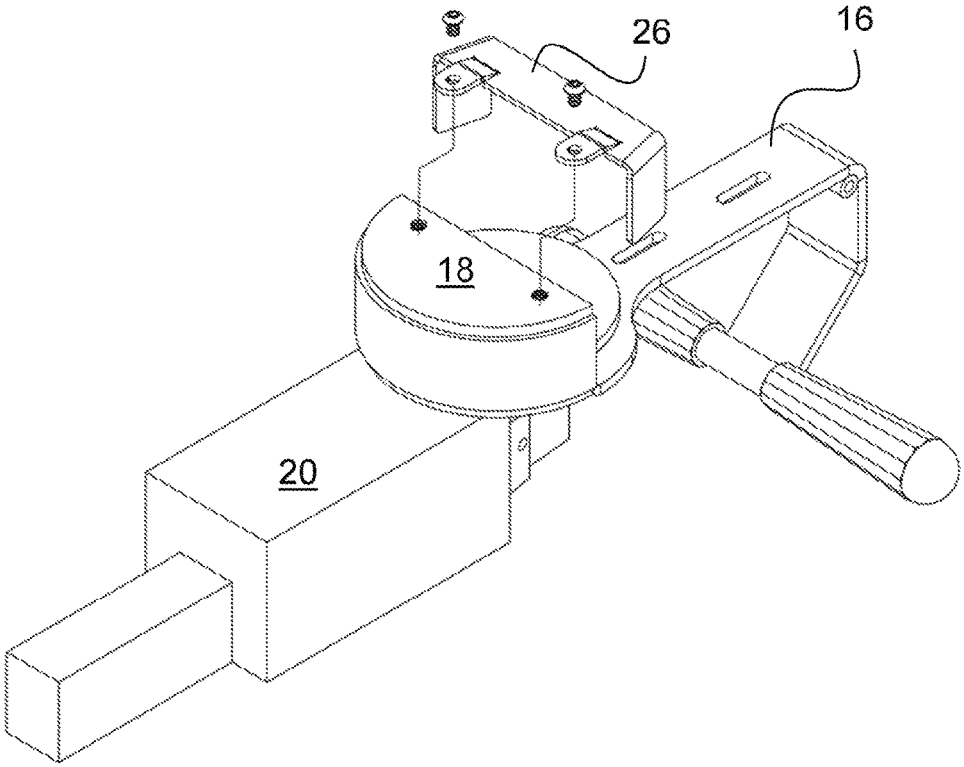
FIG. 2 Isometric reverse angle view of the invention with a pipe
Figure 3A:
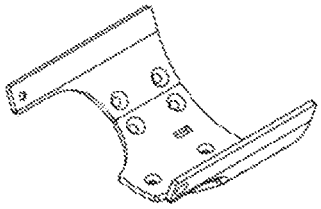
FIGS. 3A-D Isometric, top, side, and front views of the pipe adapter.
Figure 3B:
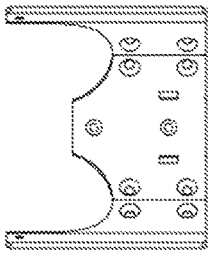
Figure 3C:
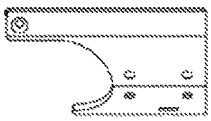
Figure 3D:
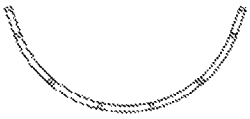
Figure 4:
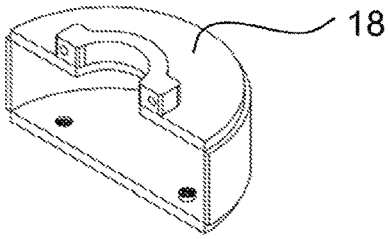
FIG. 4 Isometric view of the disc cover member.
Figure 5:
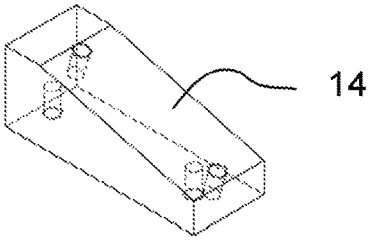
FIG. 5 Isometric see-through view of the wedge.
Figure 6:
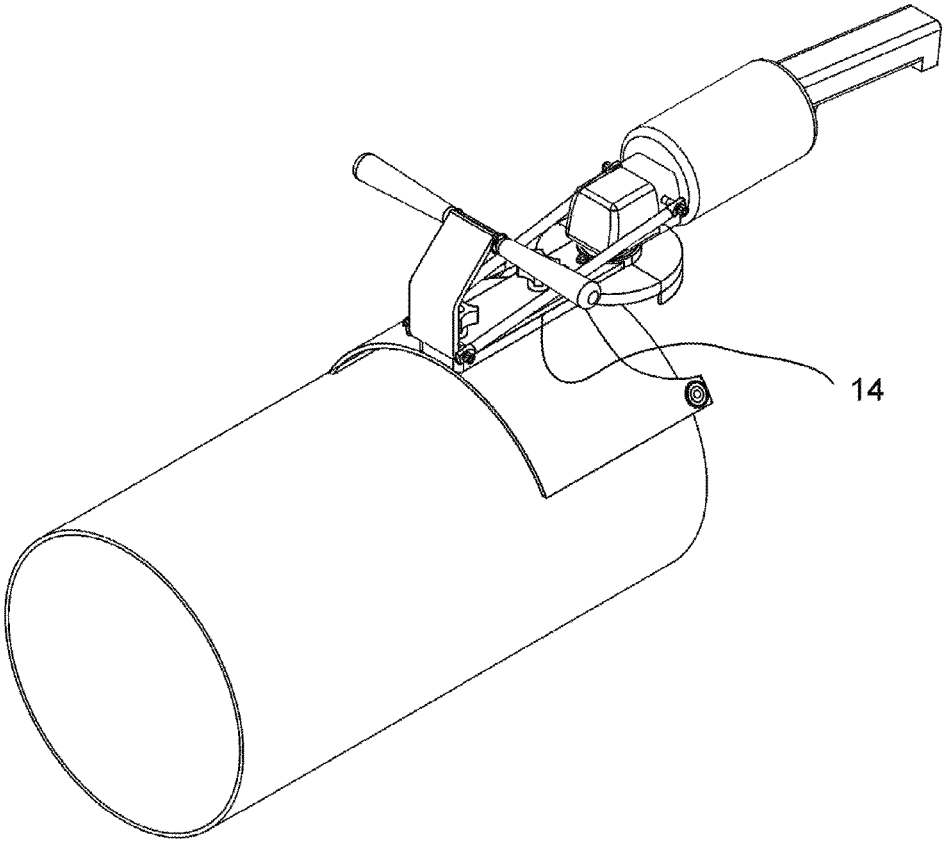
FIG. 6 Isometric view of the invention on a pipe.

A pipe beveling tool (10) is comprised of an arcuate pipe adapter (12) mechanically attached to a wedge member (14), which is itself mechanically attached to a connecting bracket (16) which is itself mechanically fastened to a disc cover member (18) in such a way that both the disc cover member (18), and the connecting bracket (16) clamp onto a grinding tool (20) section proximal a grinding disc (22) by way of tightening thereonto. The disc cover member (18) is a component that is standard to grinding tools (20) and its mode of attachment need not be further discussed herein. The connecting bracket (16) using the same mode of attachment therefore does not need to be further discussed either. The connecting bracket (16) has a pair of handles (24) extending therefrom.

A removable cover extension (26) extends the coverage of the disc beyond the cover member (18) but is easily removable to facilitate the replacement of the grinding disc (22) when necessary.

Since pipes (32) have different diameters, the pipe adapter (12) has a pair of flaps (28) hingedly attached to a fixed adapter member (30) so as to follow the contour of whatever pipe (32) diameter is on.

While rotating the pipe (32), the adapter (12) is kept in place by way of the handle members (24) as well as a pair of nipples (34) which make contact with the circumferential edge of the pipe (32). In this manner, the grinder (20) is kept at a precise position relative to the circumference of the pipe (32) and thus carve a bevel that is consistent in shape. The wedge member (14) is interchangeable and comes in a variety of shapes which represent different angles so that the bevel can be cut in any given pre-selected angle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A pipe beveling apparatus comprising a grinding tool having a grinding disc in combination with a pipe beveler tool, the improvement comprising:

said pipe beveler tool having a pair of flaps hingedly attached to a fixed adapter member so as to follow a portion of a contour of a pipe regardless of its diameter;

a connecting bracket being mechanically fastened to a disc cover member in such a way that both said disc cover member and said connecting bracket clamp onto said grinding tool proximal said grinding disc;

said removable wedge member having a given angle and being mechanically attached between said fixed adapter member and said connecting bracket to position and secure said grinding tool at an angle relative to a pipe to facilitate carving of a corresponding bevel angle onto a circumference of said pipe at said given angle; and said connecting bracket having a pair of handles extending therefrom so as to hold said pipe beveling tool in place when said pipe is being rotated.

2. The pipe beveling apparatus as in claim 1 wherein a pair of nipples make contact with an edge section of said pipe so as to hold said pipe beveling tool in place relative to the pipe's circumferential edge when a pipe is being rotated.

3. The pipe beveling apparatus as in claim 1 wherein a removable cover extension extends the coverage of said disc beyond said cover member.

* * * * *